US005567029A

United States Patent [19]

Haenisch et al.

[11] Patent Number: 5,567,029

[45] Date of Patent: Oct. 22, 1996

[54] ADJUSTABLE RETAINER ASSEMBLY FOR A REFRIGERATOR DOOR SHELF

[75] Inventors: Thomas J. Haenisch, Galesburg; Douglas A. Heims, Knoxville; Warren F. Johnson, Galesburg, all of Ill.

[73] Assignee: Maytag Corporation, Newton, Iowa

[21] Appl. No.: 361,542

[22] Filed: Dec. 22, 1994

[51] Int. Cl.[6] ..... A47F 7/00; F25D 11/00

[52] U.S. Cl. ..... 312/405.1; 312/321.5; 248/311.2; 211/100; 211/75

[58] Field of Search ..... 312/405.1, 321.5, 312/185, 187; 248/311.2; 211/75, 88, 99, 100; 24/453, 297, 697.1; 411/508, 509, 510; 220/762, 763, 764

[56] References Cited

U.S. PATENT DOCUMENTS

| | | | |
|---|---|---|---|
| 2,230,975 | 2/1941 | Gratz | 211/75 |
| 3,220,558 | 11/1965 | Olsson . | |
| 3,752,322 | 8/1973 | Fiocca et al. | 211/41 |
| 4,186,978 | 2/1980 | Thomson . | |
| 4,392,278 | 7/1983 | Mugglestone . | |
| 4,396,329 | 8/1983 | Wollar . | |
| 4,600,109 | 7/1986 | Schulz . | |
| 4,714,158 | 12/1987 | Oltman et al. | 220/763 |
| 4,717,301 | 1/1988 | Oddenino . | |
| 4,776,739 | 10/1988 | Hamman . | |
| 4,840,279 | 6/1989 | Cobb et al. . | |
| 5,038,689 | 8/1991 | Duffy | 211/42 |
| 5,119,948 | 6/1992 | Hallgrimsson | 211/42 |
| 5,160,191 | 11/1992 | Holland et al. . | |
| 5,226,717 | 7/1993 | Hoffman . | |
| 5,375,924 | 12/1994 | Pohl et al. | 312/405.1 |

FOREIGN PATENT DOCUMENTS

| | | | |
|---|---|---|---|
| 0453976 | 1/1949 | Canada | 312/405.1 |
| 0592140 | 4/1959 | Italy | 312/321.5 |
| 0424381 | 5/1967 | Switzerland | 24/297 |

*Primary Examiner*—James R. Brittain
*Assistant Examiner*—Hanh Tran
*Attorney, Agent, or Firm*—Everett G. Diederiks, Jr.

[57] ABSTRACT

A retainer assembly for preventing tall food containers placed on a shelf of a refrigerator door liner from falling off the shelf when the refrigerator door is abruptly opened or closed includes a retainer member in the form of an elongated rod or bar that includes an intermediate portion and bent end sections and a retainer element. Each of the bent end sections includes an out-turned terminal end that is pivotally connected to the dike portion of the inner liner. The retainer element preferably comprises a block that defines various spaced grooves or recesses. The retainer element is attached to a sidewall of the dike portion with the various grooves being spaced vertically. With this arrangement, the retainer member can be rotated into an in-use condition wherein it is maintained at a selected height by engagement with a predetermined groove of the retainer element and a non-use condition wherein the retainer member is rotated relative to the shelf to a position wherein the retainer member permits unobstructed access to and removal of food containers placed on the shelf.

20 Claims, 6 Drawing Sheets

ADJUSTABLE RETAINER ASSEMBLY FOR A REFRIGERATOR DOOR SHELF

BACKGROUND OF THE INVENTION

1. Field of the Invention

The present invention pertains to the art of refrigerator doors and, more particularly, to an adjustable retainer assembly for maintaining food containers in a desired storage condition upon a shelf provided in the inner liner portion of a refrigerator door.

2. Discussion of the Prior Art

It is widely known in the art to form refrigerator doors with inner liners that incorporate a plurality of shelves upon which various food containers can be stored. In order to aid in preventing food containers placed on such shelves from falling off when the refrigerator door is either opened or closed, it is common practice to provide a wall or retainer member that extends in front of each shelf to prevent tipping of the stored containers. Unfortunately, the positions of such retainer arrangements cannot readily accommodate food items of varying heights which creates a problem when tall food containers are placed on the refrigerator door shelves. Since such containers inherently have a rather high center of gravity, these containers often fall from the shelves when the refrigerator door is opened quickly or closed hard.

In an attempt to solve this known problem, it has become common practice to provide an auxiliary retainer which fits in or snaps onto the front of an inner door liner shelf. It has also been proposed to utilize an adjustable retainer unit which can be shifted in a generally horizontal plane to accommodate food containers of varying widths. An example of the latter known arrangement is exemplified by U.S. Pat. No. 5,160,191. Unfortunately, such known retainers are not vertically adjustable so as to enable repositioning of the retainer based on the particular height of the food container being stored. Therefore, these known retainer arrangements generally suffer from the same drawback in that rather tall food containers placed on the shelf still have a tendency to fall off due to abrupt movements of the refrigerator door.

It has also been heretobefore proposed to pivotally mount a retainer member to a shelf in a refrigerator such that the retainer member can be shifted vertically, although perhaps only to a rather limited degree. The problem with this known type of retainer assembly is that the retainer member tends to obstruct the placement of food containers into and the removal of food containers from the shelf even when tall food containers are not being supported and the retainer member is not needed. In other words, the retainer member always assumes some in-use position and cannot be shifted to a remote non-use position wherein it does not obstruct the placement or removal of the food containers.

Therefore, there exists a need in the art of refrigerators for a retainer assembly for use on a shelf provided on the inner liner of the refrigerator door wherein the retainer assembly is vertically adjustable so that it can assume various vertically spaced in-use positions but which can be readily shifted to a non-use position wherein the retainer assembly provides clear accessibility to the shelf and food containers placed thereon.

SUMMARY OF THE INVENTION

A retainer assembly for preventing unwanted movement of food containers placed on a shelf of a refrigerator door liner and which can be readily shifted between various, vertically spaced in-use positions and a non-use position is provided. The retainer assembly includes a retainer member that is pivotally mounted relative to the shelf so that it can be rotated to a desired vertical position and a retainer element which cooperates with the retainer member to selectively maintain the retainer member in the desired location.

The retainer member is preferably constituted by an elongated rod or bar that includes an intermediate portion and bent end sections. Each of the bent end sections includes an out-turned terminal end that is pivotally connected to the dike portions of the inner liner. The retainer element preferably comprises a block formed with various spaced grooves that define detents. The retainer element is preferably provided on a sidewall or dike of the door liner with the various grooves being spaced vertically. With this arrangement, when the retainer member is rotated relative to a base of the shelf, it can become engaged with any one of the spaced grooves of the retainer element such that the retainer member assures that food containers of varying height will be maintained on the shelf during abrupt door movements. In addition, when the retainer member is not needed, it can be readily rotated to a non-use condition wherein the retainer member permits unobstructed access to and removal of food containers placed on the shelf.

Additional features and advantages of the adjustable retainer assembly of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
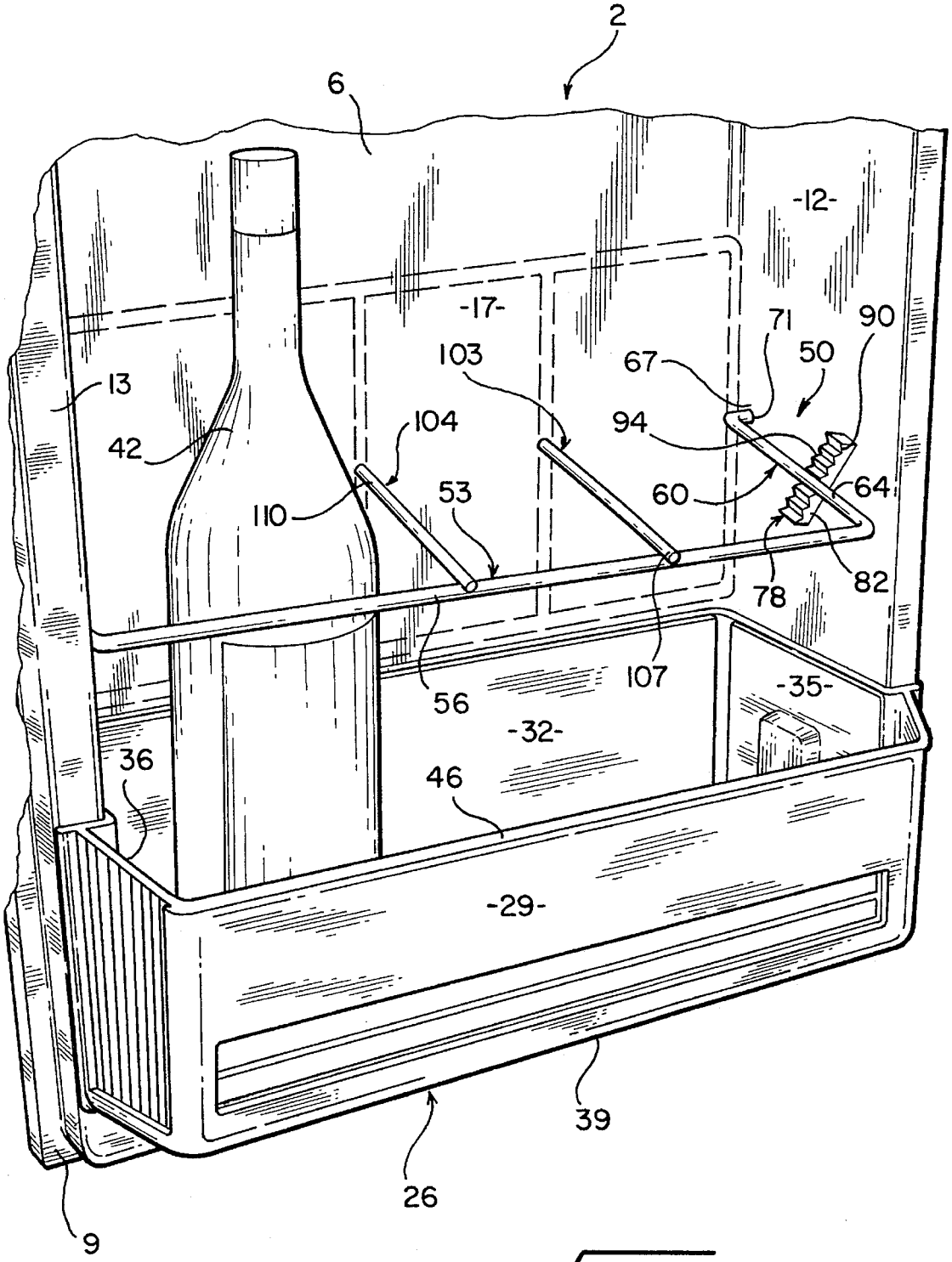
FIG. 1 is a perspective view of a portion of an inner refrigerator door that includes a shelving unit incorporating an adjustable retainer assembly according to a first embodiment of the invention.

FIG. 1 illustrates a portion of a refrigerator door 2 that includes an inner liner 6 and an outer door panel 9. As is widely known in the art, inner liner 6 is generally constituted by an integrally molded piece that is fixedly secured about an outer periphery thereof to outer door panel 9 by a plurality of fasteners (not shown). Inner door liner 6 is formed with first and second laterally spaced dike portions 12, 13 that project from an upstanding wall 17 of inner liner 6.

In the embodiment shown in FIG. 1, inner liner 6 carries a shelf unit 26 that extends between dike portions 12, 13. More specifically, shelf unit 26 includes a front wall 29, a rear wall 32, side walls 35, 36 and a base 39. Shelf unit 26 is adapted to support various food containers therein such as the tall bottle indicated at 42.

In accordance with the present invention, positioned above a top edge 46 of shelf unit 26 is a retainer assembly 50. Retainer assembly 50 includes an elongated retainer member 53 that, in the preferred embodiment described herein, is constituted by a wire rod. As illustrated, retainer member 53 includes a substantially straight intermediate section 56 having opposing end portions that are integrally connected with first and second bent sections, one of which is illustrated in FIG. 1 at 60. Each bent section 60 includes an arm portion 64 that extends substantially perpendicular to intermediate section 56 and which terminates in an out-turned terminal end 67. The terminal ends 67 of each of the first and second bent sections 60 are adapted to be received in a respective hole 71 provided in each of the dike portions 12, 13. In the preferred embodiment illustrated in FIG. 1, retainer member 53 is pivotally connected to dike portions 12, 13 directly adjacent upstanding wall 17 so as to be rotatable between a non-use condition wherein the retainer member 53 is pivoted either upwardly or downwardly to a position juxtaposed to upstanding wall 17 as illustrated by the dotted lines in FIG. 1 and an in-use condition wherein arm portion 64 projects outwardly from upstanding wall 17 such that intermediate section 56 extends between dike portions 12, 13 at a position spaced from upstanding wall 17 such that retainer member 53 can aid in retaining food container 42 within shelf unit 26 even when rather large forces developed during opening and closing of refrigerator door 2 are transmitted to food container 42 which tends to cause food container 42 to topple off shelf unit 26.

In order to maintain retainer member 53 in any one of a plurality of vertically spaced positions when retainer member 53 is in its in-use condition, the adjustable retainer assembly 50 of the present invention also incorporates a detent arrangement. This detent arrangement in the embodiment of FIG. 1 is constituted by a retainer element 78 in the form of a block 82 that may have a rectangular or a generally curvilinear configuration. Block 82 includes an upper undulating surface defined by trough portions 90 arranged between crest portions 94. As clearly shown in FIG. 1, block 82 is secured to dike portion 12 of inner liner 6 such that trough portions 90 are vertically spaced with respect to each other. In this embodiment, block 82 constitutes a straight member that is mounted to dike portion 12 at an angle to the vertical. Although not shown in this figure due to the perspective view illustrated, in the preferred embodiment another block 82 is also secured to dike portion 13. When in its in-use condition, retainer member 53 can be pivoted such that arm portion 64 of each bent section 60 is arranged within a selected one of the trough portions 90, between successive crest portions 94. Due to this arrangement, retainer member 53 can be rotated about an axis defined by out-turned terminal ends 67 to raise or lower intermediate section 56 relative to top edge 46 of shelf unit 26 in order to accommodate different sized food containers 42 placed upon shelf unit 26 while still enabling retainer member 53 to be maintained in its desired position due to the cooperation between bent sections 60 and retainer elements 78, The embodiment shown in FIG. 1 also illustrates the potential for incorporating a plurality of finger members 103 and 104 that function as lateral dividers for various food containers between dike portions 12 and 13. In the specific embodiment shown, finger members 103 and 104 each include a first end portion 107 that is fixedly secured, such as by welding, to intermediate section 56 of retainer member 53 and a second end portion 110 that extends from intermediate section 56 toward upstanding wall 17. Finger members 103 and 104 aid in preventing food containers placed in shelf unit 26 from toppling over laterally onto each other.

Figure 2:
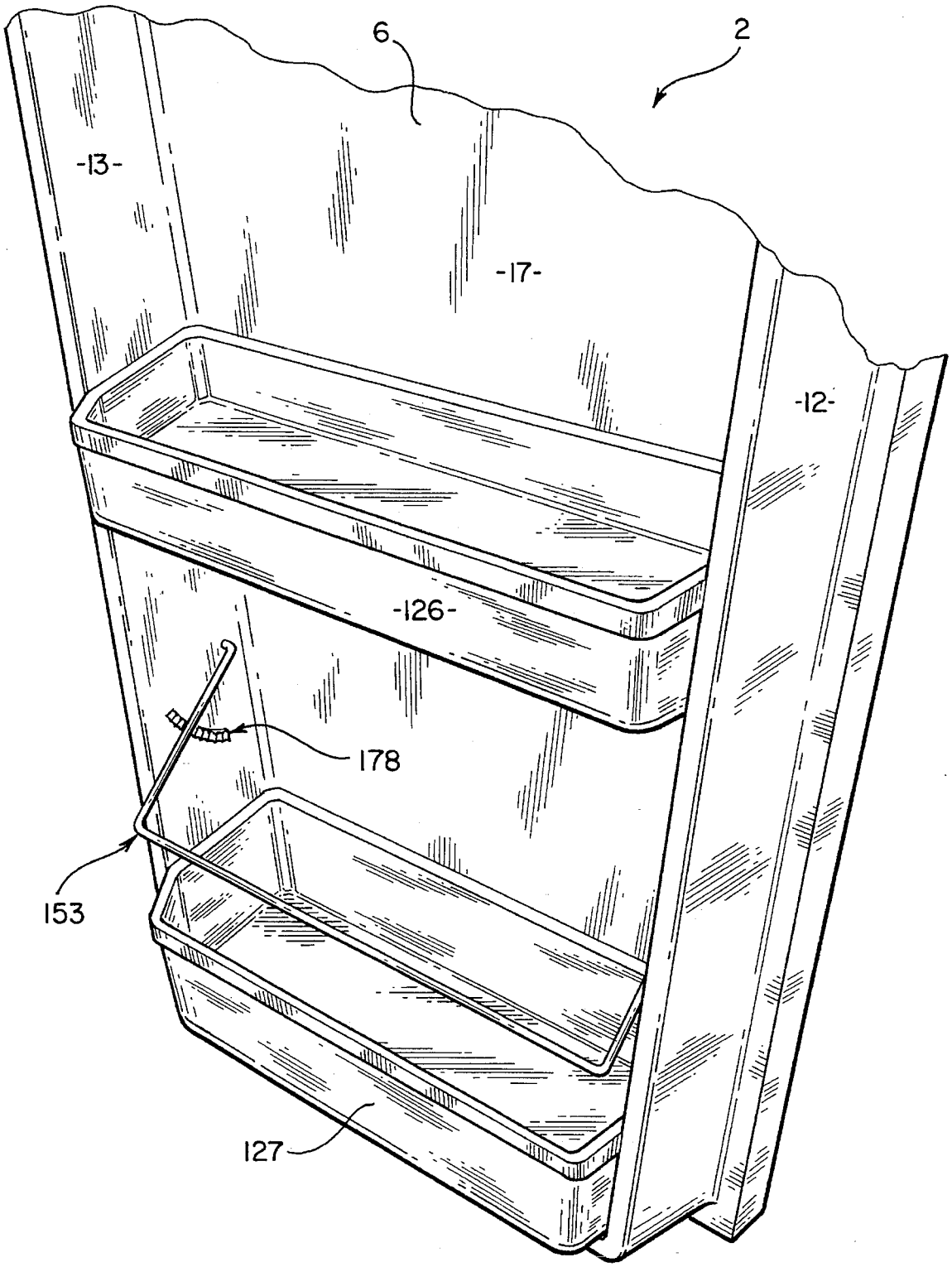
FIG. 2 is a perspective view of another refrigerator door shelving arrangement incorporating an adjustable retainer assembly according to a second embodiment of the invention.

FIG. 2 illustrates a second embodiment of the invention which is substantially identical to the embodiment of FIG. 1 and like reference numerals have been used to refer to corresponding parts in this drawing to the embodiment of FIG. 1. The FIG. 2 embodiment includes upper and lower shelf units 126 and 127 which are arranged between dike portions 12 and 13. A retainer member 153, constructed substantially identical to retainer member 53 of the embodiment of FIG. 1 is provided for the lower shelf unit 127. As in the embodiment of FIG. 1, retainer member 153 is pivotally connected to dike portions 12 and 13 directly adjacent upstanding wall 17 such that retainer member 153 will not obstruct the placement of food containers into or the removal of food containers from lower shelf unit 127 when retainer member 153 is in its non-use condition. The embodiment of FIG. 2 actually only differs from the embodiment of FIG. 1 with respect to the presence of a curvilinear retainer element 178. As in the embodiment of FIG. 1, two such retainer elements 178 are preferably provided, one on each of dike portions 12 and 13 with only a single retainer element 178 being shown in FIG. 2 attached to dike portion 13. It should also be noted that retainer element 178 can be defined by an auxiliary block that is secured to dike portion 13 or could be integrally formed with dike portion 13.

Figure 3:
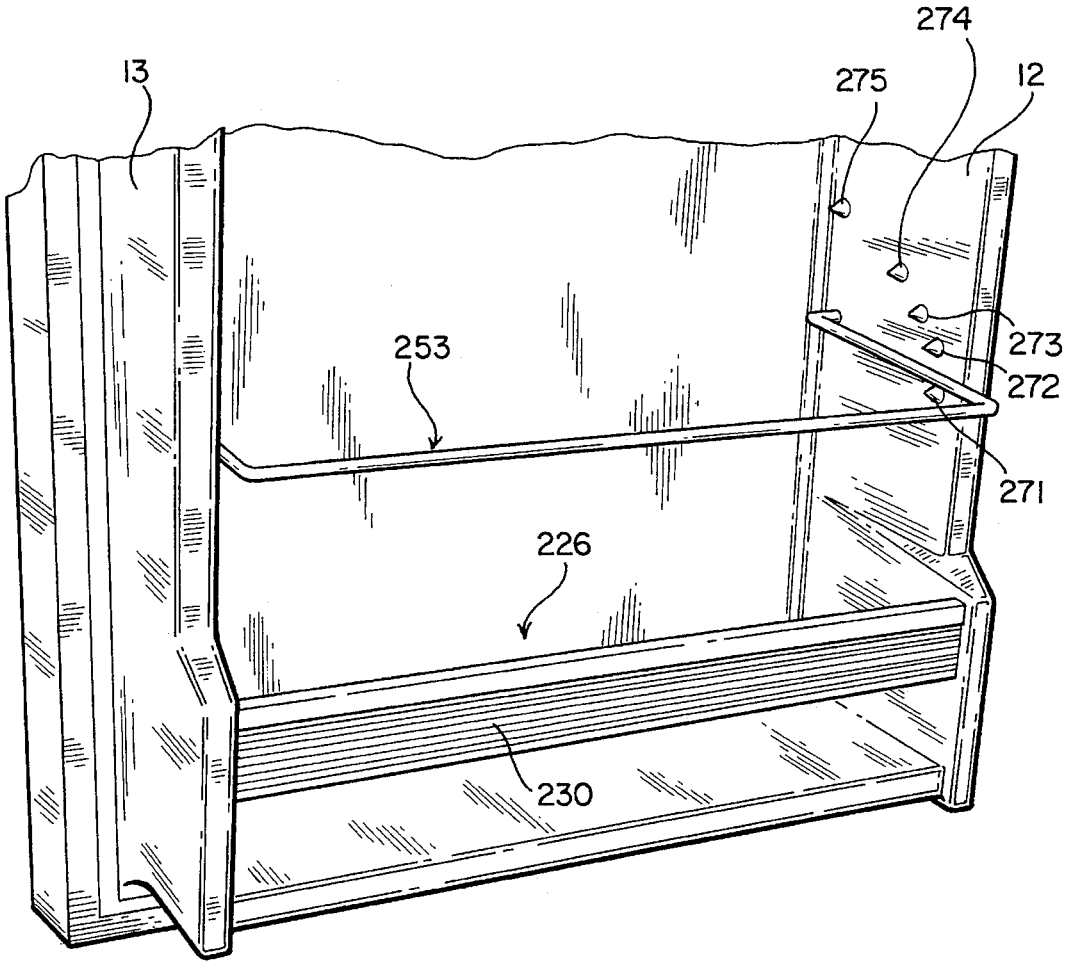
FIG. 3 illustrates another retainer assembly in accordance with the present invention on a different type of refrigerator shelf arrangement.

In the embodiment of FIG. 3, a shelf unit 226 is integrally formed with dike portions 12 and 13 and a standard, fixed retainer bar 230 extends between and is connected to each of dike portions 12 and 13. Vertically spaced above fixed retainer bar 230 in the embodiment of FIG. 3 is an adjustable retainer member 253. Again, retainer member 253 is constructed and rotatably mounted in a manner directly analogous to that describe above with respect to the embodiments of FIG. 1 and 2 and therefore the specifics thereof will not be reiterated here. The embodiment of FIG. 3 generally differs from the previously described embodiments with respect to the detent arrangement utilized. In this embodiment, at least one of dike portions 12 and 13 are provided with a plurality of spaced conical projections 271–275. In the preferred embodiment, projections 271–275 are integrally formed with dike portions 12, 13, however, conical projections 271–275 could also be formed as individual members which are attached to dike portions 12 and 13. In addition, the particular number of projections 271–275 actually utilized could readily vary in accordance with the present invention without departing from the spirit thereof. It is only important to realize that retainer member 253 can be rotated relative to dike portions 12 and 13 to various in-use positions defined between adjacent conical projections 271–275. In addition, adjustable retainer member 253 can be placed in a non-use condition wherein retainer member 253 is retained between upstanding wall 17 and conical projection 275.

Figure 4:
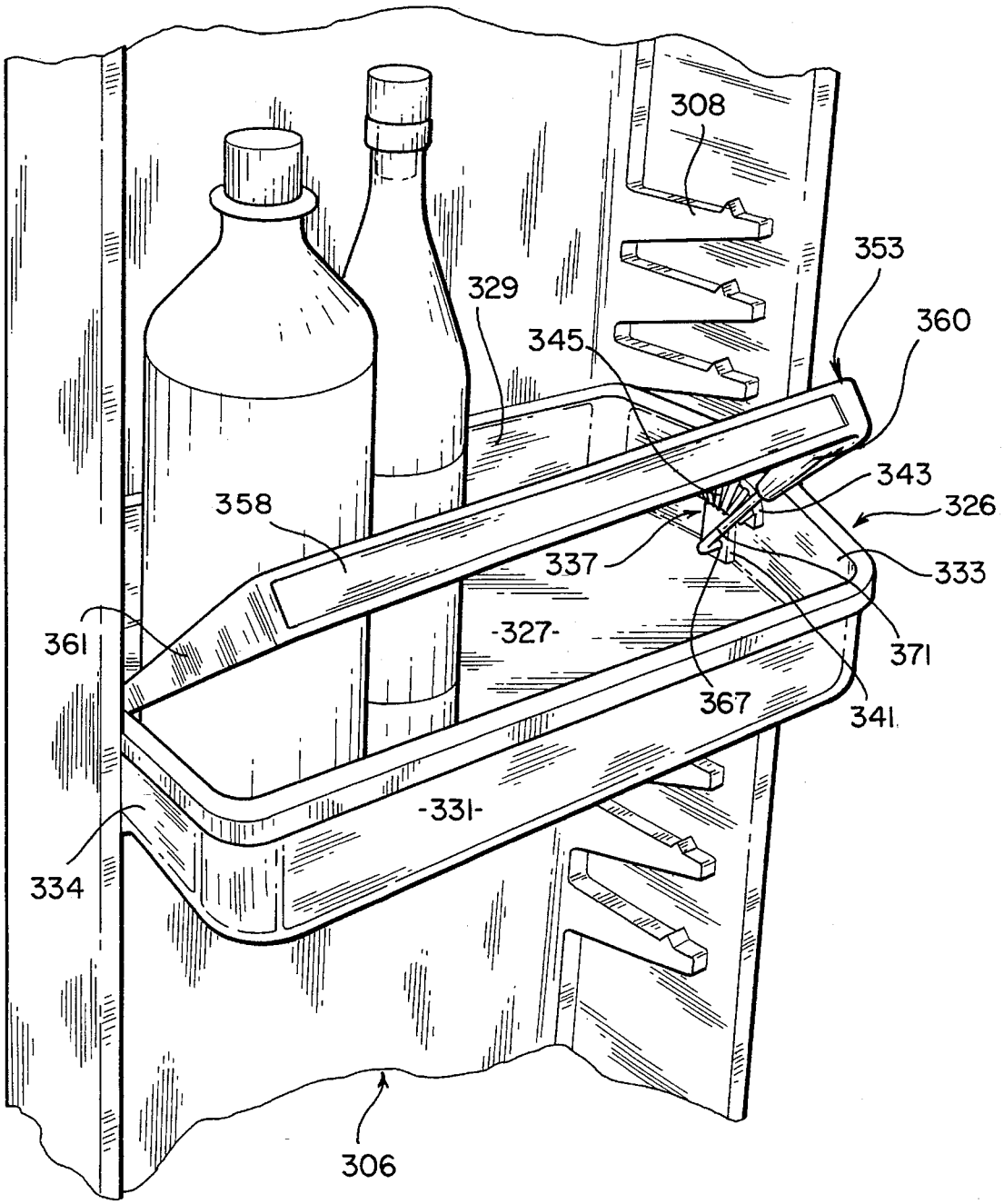
FIG. 4 shows a partial perspective view of a still further adjustable retainer assembly for use on a removable refrigerator door shelf.

FIG. 4 illustrates another embodiment of the invention wherein another adjustable retainer assembly constructed in accordance with the present invention is utilized in combination with a refrigerator door having an inner liner 306 that is formed with a plurality of vertically spaced prongs 308 for supporting a removable shelving unit 326. Removable shelving unit 326 includes a base 327, a rear wall 329, front wall 331 and sidewalls 333 and 334. Each side wall 333, 334 has fixedly secured thereto or integrally formed therewith a bracket 337 that is generally mushroom-shaped so as to define a stem portion 341 and a head portion 343. Head portion 343 includes an undulating surface 345 defined by successive trough and crest portions (not labeled).

The embodiment of FIG. 4 also includes a retainer member 353 that includes a substantially straight handle portion 358 and bent sections 360 and 361 that terminate in out-turned, terminal ends, one of which is indicated at 367. As with the embodiments of FIGS. 1–3, out-turned terminal ends 367 are used to rotatably mount retainer member 353. For this purpose, stem portion 341 of each bracket 337 is provided with a hole 371 for receiving a respective one of the out-turned terminal ends 367.

In the embodiment of FIG. 4, it should be readily apparent that retainer member 353 is entirely located within the storage area of shelving unit 326 and can be placed in an in-use condition wherein retainer member 353 can be arranged at a desired angle to base 327 by the interengagement between at least one bent section 360, 361 and the undulating surface 345 of bracket(s) 337 and a non-use condition wherein retainer member 353 is arranged in an unobstructing position within shelving unit 326 directly adjacent either rear wall 329 or front wall 331.

Figure 5:
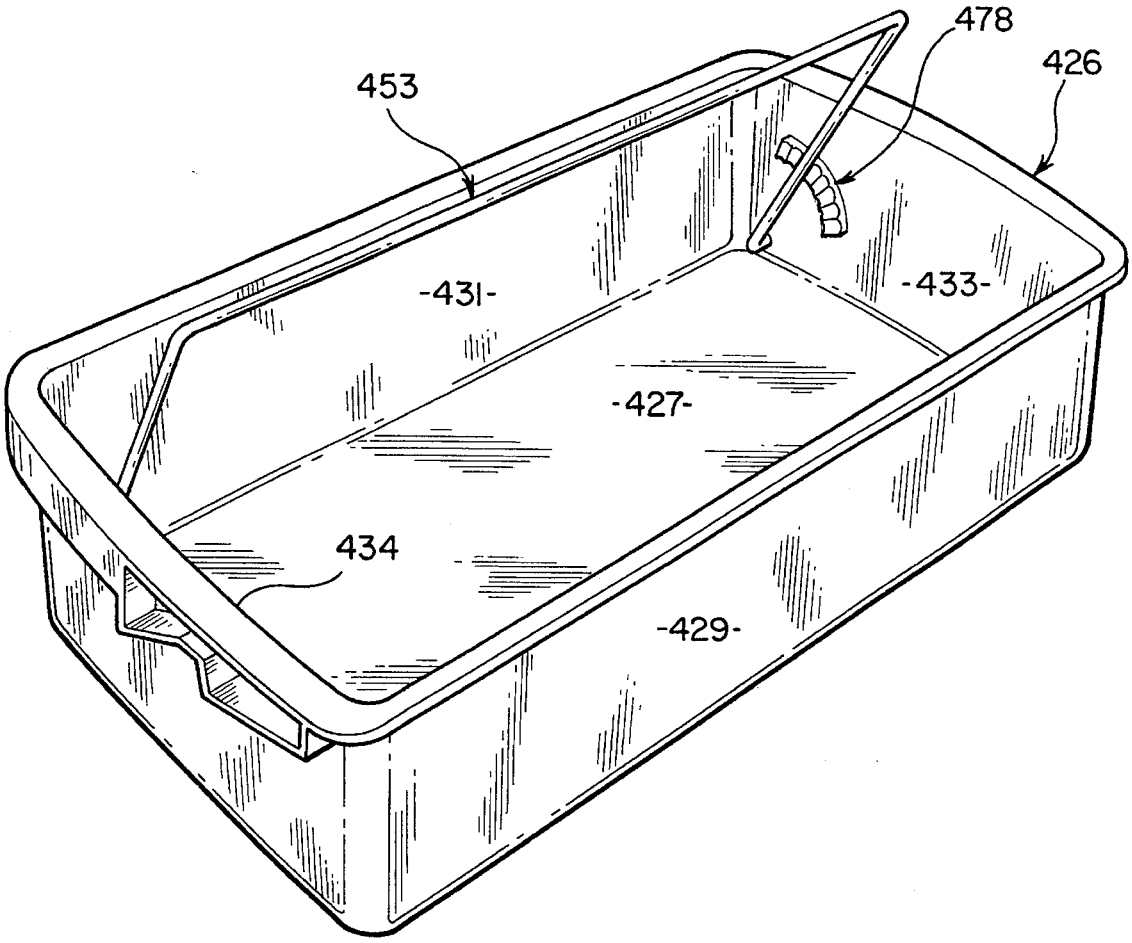
FIG. 5 depicts an alternative adjustable retainer assembly attached to a removable shelf.
Figure 6:
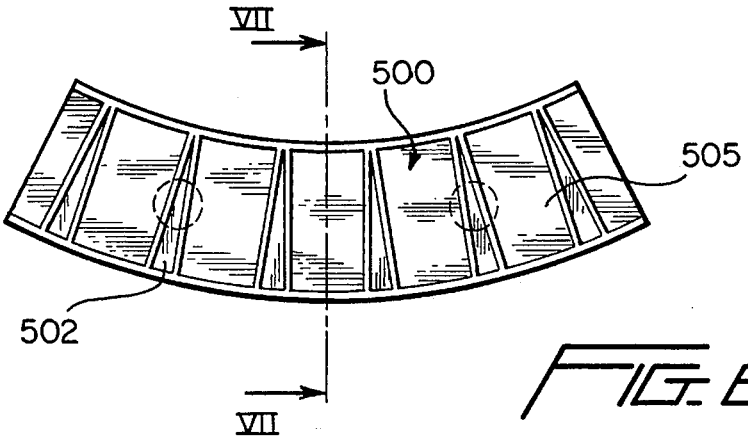
FIG. 6 is a front plan view of a preferred embodiment of a retainer element incorporated in the retainer assembly of the present invention.
Figure 7:
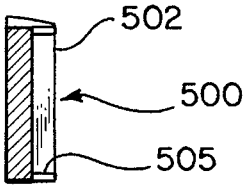
FIG. 7 is a cross-sectional view generally taken along line VII—VII in FIG. 6.
Figure 8:
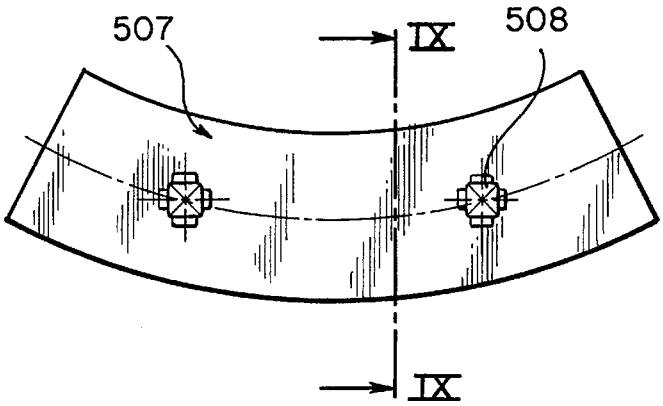
FIG. 8 is a rear plan view of the retainer element of FIG. 6.

FIG. 5 is a perspective view of another removable shelf 426, similar to that shown in FIG. 4, which includes a base 427, rear wall 429, front wall 431 and sidewalls 433 and 434. Shelf 426 has rotatably attached thereto a retainer member 453 that is constructed identical to the retainer members incorporated in the embodiments of FIGS. 1–3. In addition, removable shelf 426 includes at least one retainer element 478 that is integrally formed with or, preferably, fixedly secured to at least one side wall 433, 434 adjacent front wall 431. As clearly shown in FIG. 5, retainer member 453 is pivotally attached to removable shelf 426 by means of a pivotal interconnection with sidewalls 433 and 434, directly adjacent front wall 431 and base 427. Retainer element 478 incorporated in the embodiment of FIG. 5 is constructed identical to and cooperates with retainer member 453 in the same manner as discussed above with respect to retainer element 478. For this reason, it is believed that the structure and operation of the adjustable retainer assembly of the embodiment of FIG. 5 should be readily understood. It should be noted, however, that in its non-use condition, retainer member 453 can be positioned along base 427 so as to not obstruct the placement of food containers onto or the removal of food containers from shelf 426.

In each of the preferred embodiments described above, it is important to note that each adjustable retainer assembly includes a retainer member that cooperates with a retainer element in order to allow the retainer member to assume, in an in-use condition, a plurality of vertically spaced positions so that the retainer member can be used to accommodate food containers of varying heights and widths placed on the shelves. In addition, the retainer member in each of the adjustable retainer assemblies described can be shifted to a position in which it does not at all obstruct the placement of food containers into or the removal of food containers from the various shelving units. This is considered to be a major advantage over the retainer member arrangements known in the prior art. When in their unobstructed or non-use positions, the retainer members according to the present invention actually do not alter the configuration of the shelves but rather food containers can be placed upon and removed from the shelves as if the adjustable retainer assemblies were not even present. This is important in that refrigerator shelves in general have been already designed for ease of access and any additional structure thereto generally attends to deteriorate or adversely affect this accessibility.

Figure 9:
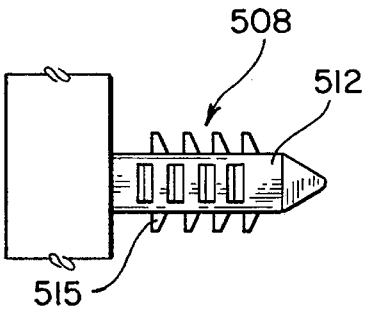
FIG. 9 an enlarged, partial cross-sectional view generally taken along line IX—IX in FIG. 8.

FIGS. 6–9 illustrate a preferred embodiment of a retainer element that can be utilized in each of the embodiments described above. Actually, the retainer element shown in these figures is incorporated in the embodiment described with respect to FIG. 2. As shown in FIGS. 6–9, the retainer element includes an exposed side 500 that is formed with a plurality of spaced upstanding, triangular-shaped crest portions 502 that define trough or recessed areas 505 therebetween. The retainer element also includes a mounting side 507 which preferably has projecting therefrom a plurality of spaced fasteners 508. Each fastener 508, as best shown in FIG. 9, includes a shaft portion 512 that is formed with a plurality of pliable prongs 515. As clearly shown in FIG. 9, prongs 515 taper from the end of shaft 512 toward the body of the retainer element. With this arrangement, the retainer element can be readily secured at any desired location by forming bores or holes into which the shaft portion 512 of a respective fastener 508 is inserted. Due to the configuration of prongs 515, shaft portion 512 is adapted to be readily inserted within such bores or holes but yet prongs 515 tend to grip the inner surface of the hole or bore and prevent shaft portions 512 from being readily removed therefrom.

Although described with respect to preferred embodiments of the invention, it should be readily understood that various changes and/or modification can be made to the invention without departing from the spirit thereof. In general, the invention is only intended to be limited by the scope of the following claims.

We claim:

1. In a refrigerator door including an inner liner having an upstanding wall portion with laterally spaced dike portions projecting therefrom and at least one shelf including a base for supporting various food items located between said dike portions, an adjustable retainer assembly comprising:

an elongated retainer member including an intermediate section and first and second bent sections extending from opposing end portions of said intermediate section and defining terminal ends of said retainer member;

means for pivotally connecting said terminal ends for rotation relative to the base of said shelf about an axis that is located directly adjacent the upstanding wall portion of said inner liner such that said retainer member is rotatable between a non-use condition wherein said retainer member is arranged substantially coplanar with and juxtaposed to the upstanding wall portion in order to permit unobstructed access to and removal of food containers placed on said shelf and an in-use condition wherein said retainer member extends across said dike portions, vertically spaced from the base of said shelf and outwardly of the upstanding wall of the liner; and detent means for selectively maintaining said retainer member in one of a plurality of vertically spaced positions when said retainer member is in said in-use condition.

2. An adjustable retainer assembly as claimed in claim 1, wherein each of said first and second bent sections includes an arm portion extending at an angle to a longitudinal axis defined by said intermediate section, said terminal ends projecting outwardly from said arm portions.

3. An adjustable retainer assembly as claimed in claim 2, wherein said detent means directly cooperates with at least one of said arm portions.

4. An adjustable retainer assembly as claimed in claim 2, wherein said means for pivotally connecting comprises opposing holes formed in the laterally spaced dike portions directly adjacent the upstanding wall portion of said inner liner, said terminal ends being rotatably received within said holes.

5. An adjustable retainer assembly as claimed in claim 1, further comprising at least one finger attached to said intermediate section between said first and second bent sections, said at least one finger extending from said intermediate section toward the upstanding wall of said inner liner substantially parallel to said first and second bent sections.

6. An adjustable retainer assembly as claimed in claim 1, wherein said detent means comprises an undulating surface defined by sequentially arranged crest and trough portions, each of said trough portions corresponding to a respective one of said plurality of vertically spaced positions.

7. An adjustable retainer assembly as claimed in claim 6, wherein said detent means comprises a retainer element upon which said undulating surface is formed.

8. An adjustable retainer assembly as claimed in claim 7, further comprising a plurality of fasteners extending from a surface of said retainer element opposite said undulating surface, each of said plurality of fasteners including a shaft having multiple, axially spaced prongs.

9. An adjustable retainer assembly as claimed in claim 6, wherein said retainer element is a straight element.

10. An adjustable retainer assembly as claimed in claim 6, wherein said retainer element is a curvilinear element.

11. An adjustable retainer assembly as claimed in claim 1, wherein said detent means comprises a plurality of projections extending from at least one of said dike portions at spaced intervals, said retainer member being selectively maintained between adjacently ones of said projections.

12. An adjustable retainer assembly as claimed in claim 11, wherein said projections are conically shaped.

13. An adjustable retainer assembly as claimed in claim 1, wherein said retainer member constitutes a wire rod.

14. In a refrigerator door including an inner liner having an upstanding wall portion with laterally spaced dike portions projecting therefrom and at least one shelf including front and rear sides that are spaced and interconnected by opposing sidewalls and a base for supporting various food items located between said dike portions with said shelf being readily removably attached to said inner liner, an adjustable retainer assembly comprising:

an elongated retainer member including an intermediate section and first and second bent sections extending from opposing end portions of said intermediate section and defining terminal ends of said retainer member;

means for pivotally connecting said retainer member to said shelf with said terminal ends being rotatable relative to the base of said shelf about an axis that is located directly adjacent said base such that said retainer member is rotatable between a nonuse condition wherein said retainer member is arranged substantially coplanar with said base in order to permit unobstructed access to and removal of food containers placed on said shelf and an in-use condition wherein said retainer member extends across the sidewalls of said shelf, vertically spaced from the base of said shelf and outwardly of the upstanding wall of the liner; and detent means for selectively maintaining said retainer member in one of a plurality of vertically spaced positions when said retainer member is in said in-use condition.

15. An adjustable retainer assembly as claimed in claim 14, wherein said retainer member is pivotally connected to the sidewalls of said shelf intermediate said front and rear sides of said shelf and directly adjacent said base.

16. An adjustable retainer assembly as claimed in claim 15, wherein said means for pivotally connecting includes a pair of bracket members secured to the opposing sidewalls of said shelf, at least one of said bracket members incorporating said detent means.

17. An adjustable retainer assembly as claimed in claim 14, wherein said retainer member is arranged entirely between the sidewalls of said shelf.

18. An adjustable retainer assembly as claimed in claim 14, wherein said retainer member is pivotally connected, through said means for pivotally connecting, to the sidewalls of said shelf directly adjacent said front side thereof.

19. An adjustable retainer assembly as claimed in claim 14, further comprising a handle member for aiding in removing said shelf, said handle member being formed as part of said retainer member.

20. An adjustable retainer assembly as claimed in claim 14, wherein said detent means comprises an undulating surface defined by sequentially arranged crest and trough portions, each of said trough portions corresponding to a respective one of said plurality of vertically spaced positions.

* * * * *